US007411164B2

(12) United States Patent
Wagner et al.

(10) Patent No.: US 7,411,164 B2
(45) Date of Patent: Aug. 12, 2008

(54) DEVICE FOR INDUCTIVE INJECTION OF THERMAL ENERGY INTO A PRINTING FORM FOR FIXING AN IMAGE

(75) Inventors: Michael Wagner, Untermeitingen (DE); Thomas Kothmayr, Münster (DE); Franz Peter Weissgärber, Augsburg (DE); Johann Dieter Bierl, Starnberg (DE)

(73) Assignee: MAN Roland Druckmaschinen AG, Offenbach am Main (DE)

( * ) Notice: Subject to any disclaimer, the term of this patent is extended or adjusted under 35 U.S.C. 154(b) by 470 days.

(21) Appl. No.: 11/122,544

(22) Filed: May 5, 2005

(65) Prior Publication Data

US 2005/0264631 A1 Dec. 1, 2005

(30) Foreign Application Priority Data

May 11, 2004 (DE) ..... 10 2004 023 127

(51) Int. Cl.
*H05B 6/14* (2006.01)
*G03G 15/20* (2006.01)
*B41M 7/00* (2006.01)

(52) U.S. Cl. ..... 219/619; 219/670; 219/672; 399/328; 399/330; 347/213; 101/463.1

(58) Field of Classification Search ..... 219/619, 219/670, 672–676; 399/328–335; 347/212, 347/102; 101/463.1
See application file for complete search history.

(56) References Cited

U.S. PATENT DOCUMENTS

| | | | | |
|---|---|---|---|---|
| 3,526,708 | A * | 9/1970 | Leatherman | 358/301 |
| 4,371,768 | A * | 2/1983 | Pozna | 219/633 |
| 6,195,525 | B1 | 2/2001 | Maeyama | |
| 2001/0022606 | A1 | 9/2001 | Pecher et al. | |
| 2002/0141794 | A1 | 10/2002 | Hirst et al. | |

FOREIGN PATENT DOCUMENTS

| | | |
|---|---|---|
| DE | 691 32 177 T2 | 12/2000 |
| DE | 100 08 213 A1 | 8/2001 |
| WO | WO 92/09397 | 6/1992 |

* cited by examiner

*Primary Examiner*—Philip H Leung
(74) *Attorney, Agent, or Firm*—Leydig, Voit & Mayer, Ltd.

(57) ABSTRACT

An image fixing device inductively injects thermal energy into a rotating printing form of a press for fixing an image formed on the rotating printing form by means of a digital imaging system. The fixing device has at least one inductor with at least one induction loop, a high-frequency part that forms a tuned circuit with the inductor, and a supply part that can be coupled to the inductor by means of supply lines suitable for high frequency. The inductor loop is in an elongated form aligned parallel to the circumferential direction of the rotating printing form, with the effect that the zone of energy transfer and therefore the heating zone can be configured specifically in terms of its spread in the printing form, so that a high flux density can be introduced zonally into the printing form at the point which is to be heated.

9 Claims, 3 Drawing Sheets

Figure 1:
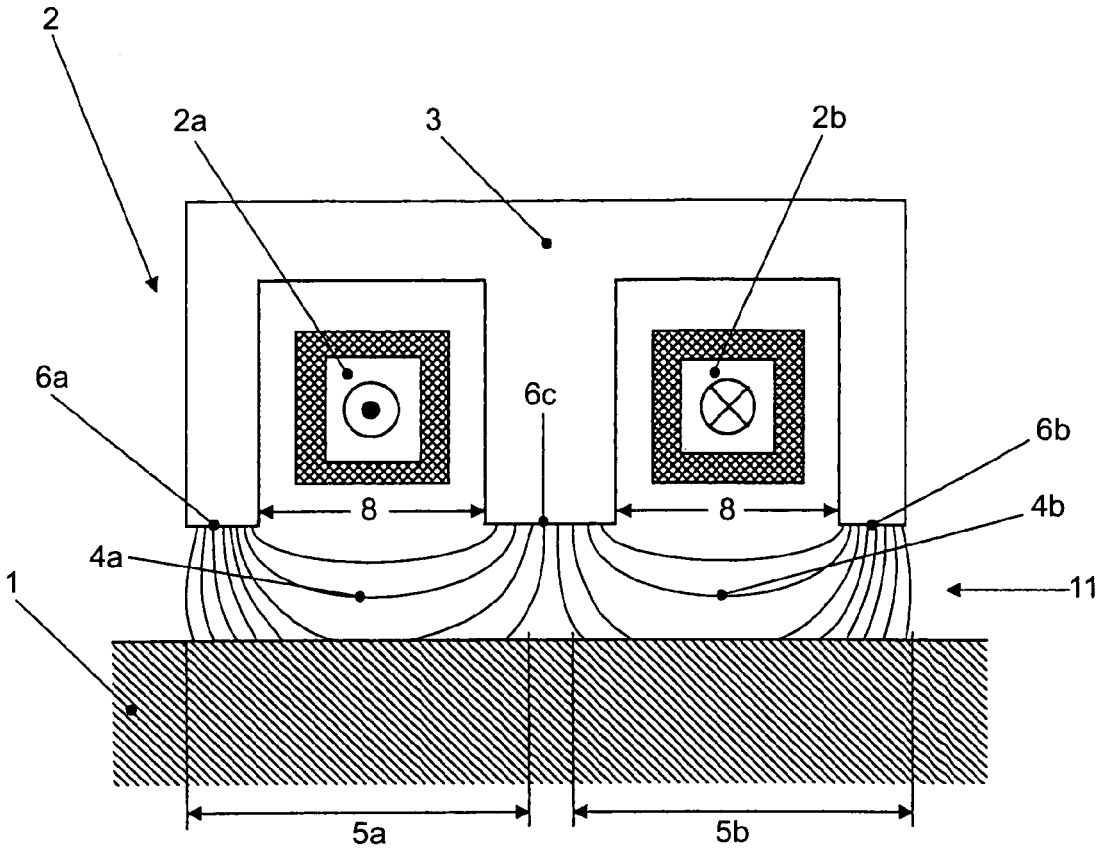

DEVICE FOR INDUCTIVE INJECTION OF THERMAL ENERGY INTO A PRINTING FORM FOR FIXING AN IMAGE

FIELD OF THE INVENTION

The invention relates to printing devices, and more particular to a device for the inductive injection of thermal energy for fixing an image on a rotating printing form imaged by means of a digital imaging system.

BACKGROUND OF THE INVENTION

A fixing device for digitally written and re-erasable offset printing forms is known for example from DE 100 08 213 A1. This device carries out the fixing by homogeneously heating the printing form surface. There, following imaging from the stock of digital data, the printing form is fixed for improved durability, wherein the ink-carrying image parts are anchored to the printing form. For this purpose, the fixing operation is carried out by means of inductively heating the image on the rotating printing form. To that end, the printing form is made of a material suitable for induction heating, and in a particularly advantageous way the frequency of the alternating current for inductive coupling is in the medium frequency range from 100 kHz to 500 kHz.

During the injection of energy by induction, heating in the interior of the metallic printing form is brought about by means of a high-frequency alternating current. As a result of what is known as the skin effect, the heating can either be placed intensely at the surface by means of high frequencies or else further into the interior of the material by means of lower frequencies. The injection of energy is in this case restricted zonally, which is advantageous in particular with regard to the power consumption. As a result of the heating of the metallic printing form, the image information previously applied to the printing form surface (consisting of thermal material in the present case) is stabilized.

SUMMARY OF THE INVENTION

The structure of a suitable induction generator comprises at least one supply unit, which is arranged in a fixed location in or on the press, and is coupled by means of supply lines suitable for high frequency (HF lines) to a high-frequency (HF) part. Each HF part forms a structural unit each having an inductor and, with the latter, in each case a tuned circuit. Each inductor comprises at least one, preferably two, inductor loops, which are in each case arranged at the front of an HF part.

The inductor loops are preferably aligned parallel to the circumferential direction of the respective printing form cylinder and approximately reproduce the curvature of the respective cylinder surface, so that they describe a coaxial shell relative to the rotating printing form cylinder and introduce heat annularly or, precisely in accordance with the inductor shape, that is to say the length of the extent in the circumferential direction, introduce heat to the respective cylinder surface in a very accurately targeted manner in accordance with being switched on and off.

Further exemplary embodiments show the inductor having an inductor loop in the form of a hairpin inductor (line inductor) of the width of the printing form, with the effect of the homogeneous introduction of heat into the respective cylinder surface.

Other forms of the inductor and inductor loops are conceivable for different applications, however. For example, the inductor loop could have an oblique position with respect to the circumferential direction of the printing form cylinder, in order also to be able to take account of variability in the format of the printing form.

In the case of induction heating, the transfer of energy into the printing form is carried out by means of the alternating magnetic field which forms around the inductor loop, through which a high-frequency alternating current flows. This type of energy transfer corresponds to the transformer principle, but the high levels of coupling which are normal there cannot be achieved. The transfer of energy and therefore the heating of the printing form take place only in the immediate proximity of the inductor to the printing form.

The current density distribution in the printing form is influenced by two effects. Firstly, as a result of self-induction in the interior of the printing form, eddy currents are generated, which are superimposed on the primary current and lead to current displacement at the printing form surface. With increasing frequency, the current flows into increasingly thinner layers underneath the printing form surface. This phenomenon is designated the skin effect, as is known. Secondly, an alternating magnetic field, which is superimposed on the alternating magnetic field from the inductor, forms around the zones of the printing form through which current flows. As a result, there is additional current displacement in the printing form and in the inductor. As is known, this is designated an approach or proximity effect and results in the heating zone becoming wider as the distance between inductor and printing form becomes greater.

In order, then, to configure the heating zones specifically on the printing form surface, the transfer of energy must be very high there and as low as possible in the surrounding regions of the printing form. Since, as previously explained, the actual transfer of energy is carried out by the alternating magnetic field, the magnetic flux intensity must be very high in the zones to be heated and as low as technically feasible in the surrounding area not to be heated. As a result, the coupling factor is improved overall.

It is, then, the object of the present invention to improve a device described at the beginning for the inductive thermal injection of energy for fixing an image in such a way that the zone of the energy transmission and therefore the heating zone can be configured specifically in terms of its spread in the printing form, so that a high magnetic flux density can be introduced zonally into the printing form at the point which is to be heated.

The object is achieved in that modules carrying magnetic field and made of a material with high permeability are slipped around the inductor loop and each have at least two end faces that face the printing form surface, in order to form a space for a magnetic field for the removal of energy.

In a particularly advantageous manner, by means of a tangential alignment of the inductor loop, the injection of energy can be achieved irrespective of the diameter of the rotating printing form and the extent of least one heating zone can be varied as a function of the adjustable gap and specific shape of the magnetic field.

In the following text, the invention will be explained in more detail using exemplary embodiments and with reference to the drawings, of which:

BRIEF DESCRIPTION OF THE DRAWING(S)

Figure 2:
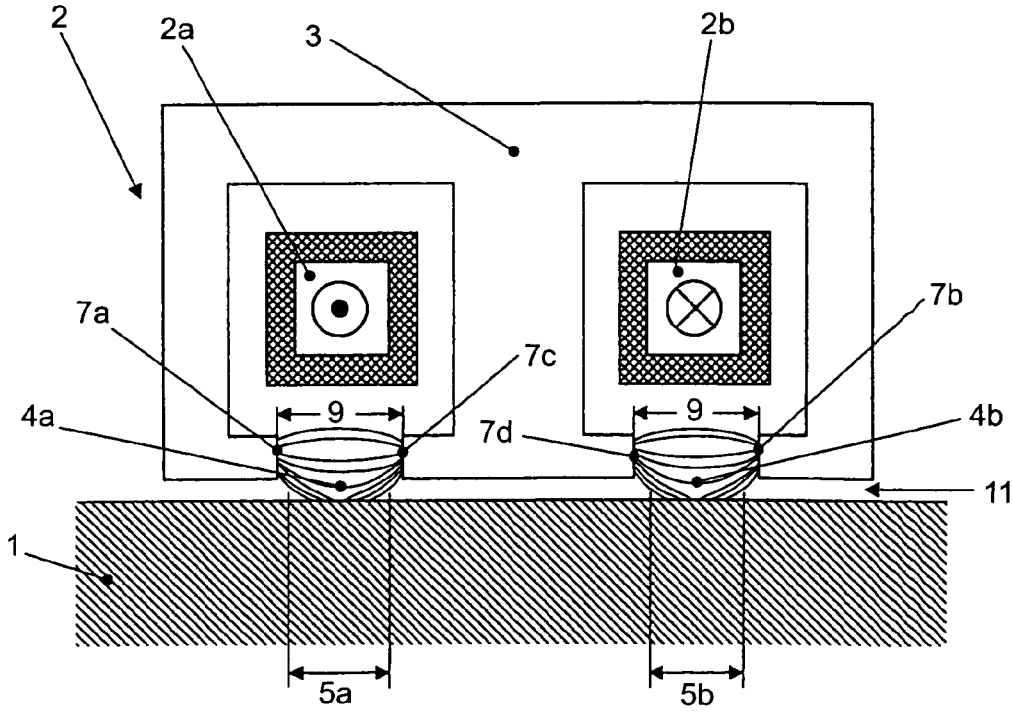
Figure 3:
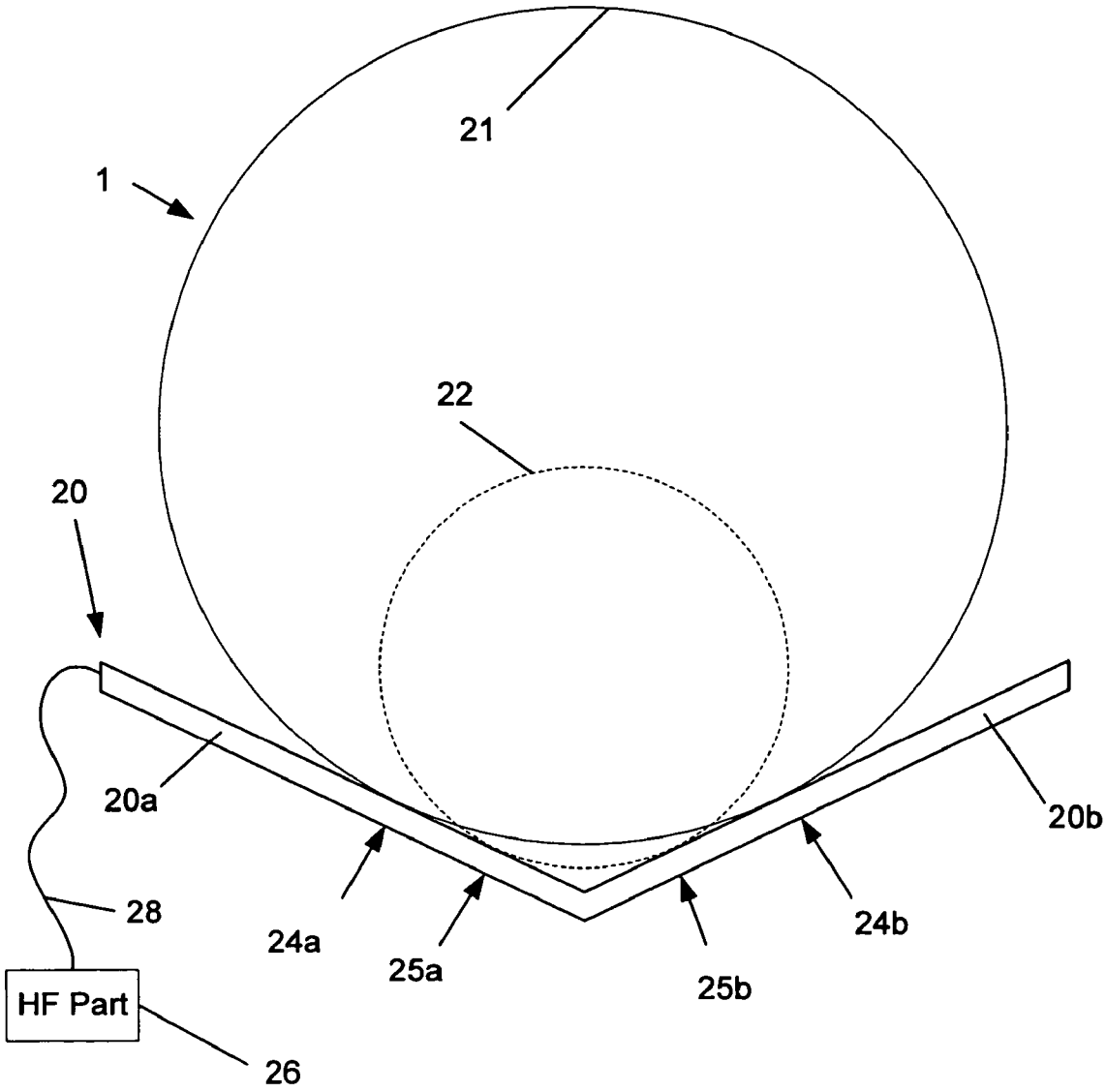
Figure 4:
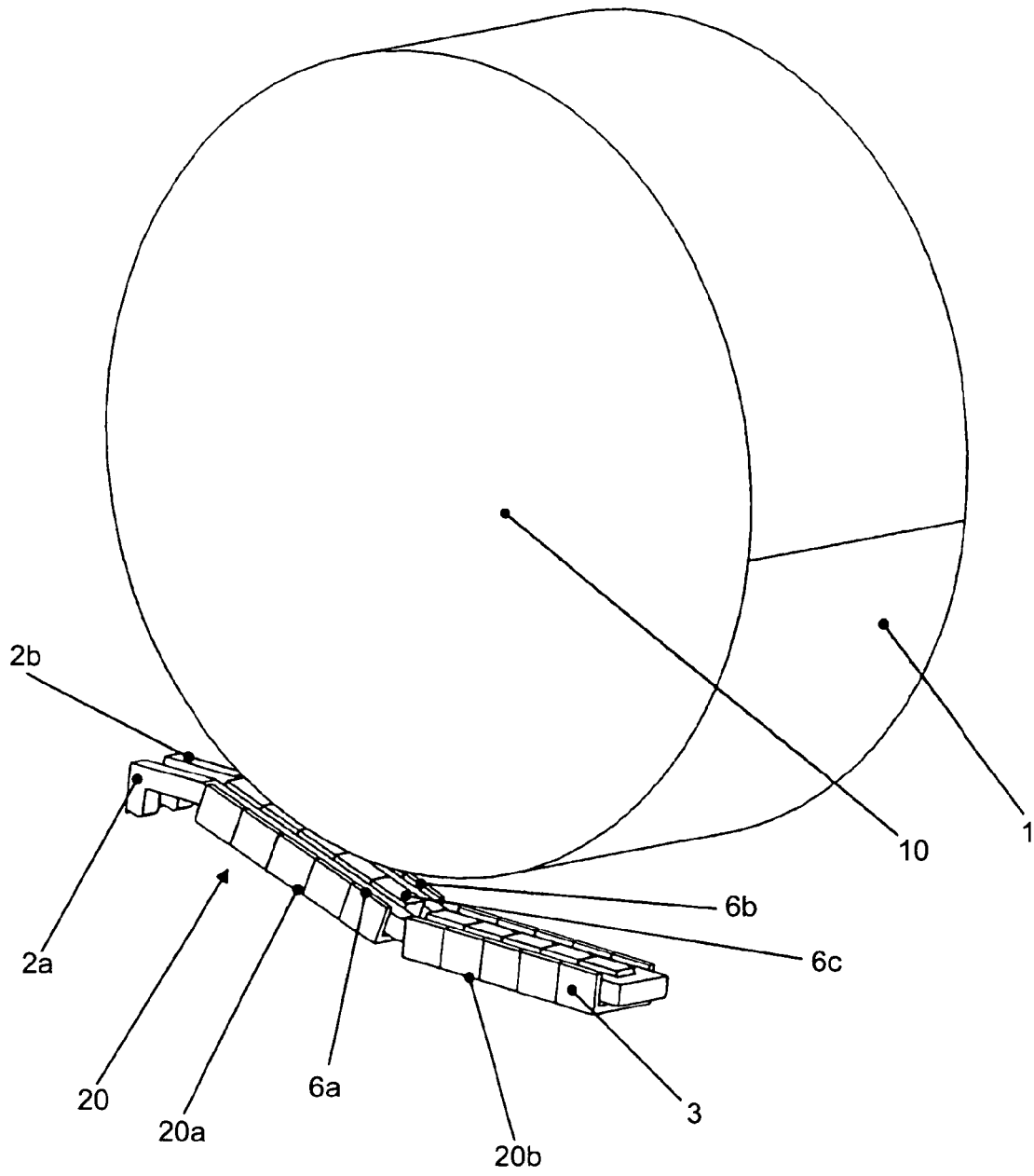

FIG. 1 shows a basic construction of an inductor in an embodiment according to the invention, comprising inductor loop and component surrounding the latter and carrying the magnetic field, for the injection of thermal energy into the printing form surface, FIG. 2 shows the inductor according to FIG. 1, but with a varied configuration of the distance between component carrying the magnetic field and printing form surface, FIG. 3 shows an inductor according to the invention in a V shape in order to achieve further points of contact, and FIG. 4 shows an inductor according to FIG. 3, which is assembled from a large number of identical ferritic modules as a link chain, which surround the inductor loop.

DETAILED DESCRIPTION OF THE INVENTION

The basic construction of an induction generator for heating rotating printing forms has already been described in DE 100 08 213 A1. Therefore, in the following description of an embodiment, only the novel constructional configurations of the generic device will be discussed.

FIG. 1 shows in section an inductor 2 having an inductor loop 2*a*, 2*b* which is aligned tangentially to one of the points of contact 24*a, b*; 25*a, b* (FIG. 3) on the printing form surface 1, forming a minimum gap 11. In the inductor 2, a conductor loop 2*a*, 2*b* through which current flows is guided by means of a copper tube and embedded in the module 3 of the inductor 2 that carries the magnetic field. Each module 3 has at least two end faces 6*a*, 6*b* of a pole shoe; in the exemplary embodiment shown, the module 3 is formed in the shape of an E, so that three end faces 6*a*, 6*b*, 6*c* are opposite the printing surface 1 and the conductor loop 2*a, b* is led between the end faces 6*a, b, c*. As is known, the space in which a magnet exerts its force action is said to have a magnetic field. As a result of the current flow in the conductor loop 2*a*, 2*b*, an alternating magnetic field 4*a*, 4*b* is produced around the inductor 2 and, injected into the printing form surface, in turn forms zones on the printing form through which current flows and creates the heating zones 5*a*, 5*b* on the printing form surface 1.

According to the invention, the module or modules 3 should consist of a material with a high permeability. Ferrites, which are sintered special electrical engineering compounds with an increased specific resistance of the core material, are particularly suitable for this purpose. As is known, they are used in particular to reduce the losses which manifest themselves to a greater extent in the cores of the coils of transformers at high frequencies.

Ferrites are materials sintered from oxides, such as $MeO.Fe_2O_3$, it being possible for Me in this connection to be, for example: Cn, Mg, Ba, Zn, Cd, Mn, Co or Ni.

According to FIG. 2, the E-shaped component 3, referred to as a pole shoe, is slipped over the conductor loop 2*a*, 2*b* and having four end faces 7*a*, 7*b*, 7*c*, 7*d*, in each case two end faces 7*a*, 7*c* and 7*b*, 7*d* being aligned opposite and perpendicular to the printing form surface 1, between which in each chase a magnetic field 4*a*, 4*b* forms, so that there heating zones 5*a*, 5*b* over a smaller gap 11 are reduced considerably in width because of the highly compressed magnetic field 4*a*, 4*b*.

The permeability is the product of the magnetic field constant and the permeability index of the material. By using materials with a high permeability for the modules 3 slipped over the conductor loop 2*a*, 2*b* and by means of the configuration of the modules 3, in particular the ferrites, as indicated in FIGS. 1 and 2, the alternating magnetic field 4*a, b* can therefore be injected into the printing form in a much more specific manner. Thus, the spread of the heating zones 5*a*, 5*b* on the printing form surface 1 can be configured specifically.

Furthermore, by means of a particularly advantageous shape of the inductor loop, the injection of energy can be implemented irrespective of the diameter of the rotating printing form. FIG. 3 shows the V-shaped inductor 20 according to the invention. The V shape is implemented by means of two limbs 20*a*, 20*b* which are set tangentially precisely in a V shape on the printing form surface 1, the limbs 20*a*, 20*b* being connected to each other in order to form the V engaging around the printing form surface 1.

For different possible printing form diameters, for example identified by 21 and 22, each limb 20*a*, 20*b* of the V shape results in a point of contact 24*a* or 25*a* or 24*b* or 25*b*, at which the conditions for the injection of energy are optimal. If this inductor shape is additionally equipped in accordance with the invention with the previously described materials which have a high permeability, the properties of the independence of the printing form diameter (format variability) and the configuration of the heating zones 5*a*, 5*b* on the printing form surface can be combined optimally.

FIG. 4 indicates once more that each limb 2, 20 of the inductor 2 is assembled from a large number of identical modules 3 as a linked chain. Each module 3 is a commercially available ferrite fabricated in the shape of an E, whose end faces 6*a, b, c* or 7*a-d* forming magnetic poles can be configured in the manner described previously. Of course, any suitable end face configuration is conceivable but at least two end faces are necessary in order to provide space for a magnetic field, which in turn forms heating zones.

The specific adaptation and finding of a suitable inductor shape was a substantial part of the present invention. In a particularly preferred way, an inductor 2, 20 having two inductor loops, which are in each case formed in a V shape parallel to the circumferential direction of the printing form surface, is implemented. Other shapes of the inductor or inductor loops are, however, conceivable for different applications.

The construction described in DE 100 08 213 A1 of a device for the inductive injection of energy for heating printing forms can thus be extended by the V shape for the inductor loops. Furthermore, all the embodiments described there of an inductor can be equipped with materials according to the invention which have a high permeability.

In order to achieve the desired zonal heating over the entire printing form surface 1, provision is made to traverse the inductor 2, 20 with inductor loops in a structural unit together with an HF part (or component) 26 in the axial direction of the rotating printing form 10.

However, HF 26 part and inductor would not have to represent one structural unit; the HF part can also be arranged in a fixed location in the press and coupled to the traversable inductor by flexible leads 28 as shown in FIG. 3. As is known, in a press many necessary guards, finger-protection rods, emergency stop switches and so on are provided on the individual units. In an advantageous embodiment, provision is made to integrate the inductor into the finger guard in the gap zone between a printing form on a printing form cylinder and a blanket cylinder, which would mean that a particularly space-saving variant could be implemented.

The present device for the inductive injection of thermal energy is conceived in particular for a printing form imaged by means of a laser-induced thermal transfer process, but it is also conceivable to cover the demand for heat at another point within the press, for example in the form of an inductively heated dryer.

As is known, by means of a specific mechanism the imaging unit can firstly be thrown on and off the printing form and, secondly, when the press cylinders can be thrown off one another, for example with the effect of taking account of a format variability of the printing form, the imaging unit can of course be moved with them in a corresponding way. In exactly the same way, the inductor can be moved with them, for which purpose it is advantageously assigned permanently to the imaging unit in conjunction with its HF part.

The invention claimed is:

1. A device for inductive injection of thermal energy into a rotating printing form of a press for fixing an image formed on the rotating printing form, comprising:

at least one inductor having at least one induction loop in an elongated form and aligned approximately parallel to a circumferential direction of the rotating printing form, the inductor being a V-shaped structure having two limbs each set tangentially over the printing form surface;

a high-frequency part which, together with the inductor, forms a tuned circuit;

an energy supply coupled by supply lines to the inductor; and multiple field-carrying modules made of a high permeability material, the field-carrying modules being slipped around the at least one inductor loop to form a linked chain and having at least two end faces for projecting an alternating magnetic field into a surface of the printing form to inject thermal energy into the printing form.

2. A device as in claim 1, wherein the inductor is aligned tangentially to the surface of the printing form and spaced from said surface by a gap to provide zonal heating of the printing form surface.

3. A device as in claim 1, wherein the inductor has two induction loops.

4. A device as in claim 1, wherein the field-carrying module is made of ferrite.

5. A device as in claim 4, wherein the field-carrying module has an E-shape and three end faces pointing towards the printing form surface.

6. A device as in claim 4, wherein the field-carrying module has an E-shape and four end faces formed into opposing pairs to compress the alternating magnetic field to reduce a size of heating zones formed on the printing form surface.

7. A device as in claim 1, wherein the inductor is movable to traverse in an axial direction of the rotating printing form.

8. A device as in claim 7, wherein the high-frequency part is arranged in a fixed location in the press and connected to the inductor via flexible lines.

9. A device as in claim 1, wherein the high-frequency part and the inductor form a structural unit movable to traverse in an axial direction of the rotating printing form.

* * * * *